US007052199B2

(12) United States Patent
Rousselet

(10) Patent No.: US 7,052,199 B2
(45) Date of Patent: May 30, 2006

(54) PRODUCT APPLICATOR AND METHOD OF PRODUCING SUCH AN APPLICATOR

(75) Inventor: Guilhem Rousselet, Saint Maur des Fossés (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/465,624

(22) Filed: Jun. 20, 2003

(65) Prior Publication Data

US 2004/0040567 A1 Mar. 4, 2004

Related U.S. Application Data

(60) Provisional application No. 60/391,235, filed on Jun. 26, 2002, provisional application No. 60/391,090, filed on Jun. 25, 2002.

(30) Foreign Application Priority Data

Jun. 20, 2002 (FR) ..... 02 07640

(51) Int. Cl.
*A46B 11/00* (2006.01)

(52) U.S. Cl. ..... 401/129; 15/206; 15/207.2

(58) Field of Classification Search ..... 401/122, 401/126, 129; 15/206, 207, 207.2; 300/5, 300/7, 8; D4/131–135
See application file for complete search history.

(56) References Cited

U.S. PATENT DOCUMENTS

| | | | | |
|---|---|---|---|---|
| 3,087,223 | A * | 4/1963 | Raw | 26/27 |
| D260,949 | S * | 9/1981 | Megna | D4/136 |
| 4,504,998 | A * | 3/1985 | Price et al. | 15/186 |
| 4,561,456 | A * | 12/1985 | Gueret | 132/218 |
| 5,161,554 | A | 11/1992 | Fitjer | |
| 5,197,497 | A | 3/1993 | Gueret | |
| 5,357,647 | A | 10/1994 | Gueret | |
| 6,141,818 | A | 11/2000 | Weihrauch | |
| 6,210,060 | B1 | 4/2001 | Gueret | |

FOREIGN PATENT DOCUMENTS

| | | |
|---|---|---|
| FR | 2 668 905 | 5/1992 |
| JP | S63-143006 | 6/1988 |
| JP | H9-125 | 3/1997 |
| JP | H09-140446 | 6/1997 |

* cited by examiner

*Primary Examiner*—David J. Walczak
(74) *Attorney, Agent, or Firm*—Finnegan, Henderson, Farabow, Garrett & Dunner, LLP

(57) ABSTRACT

A device for applying a product may comprise a support and a plurality of polymeric fibers mounted to the support. Each of the plurality of fibers may have at least one free end and each of at least some of the fibers may define at least one curved portion extending continuously from the support to the free end. An average radius of curvature of the curved portions may be less than approximately 45 mm. Further, curved portions of the fibers may be randomly oriented relative to each other.

128 Claims, 4 Drawing Sheets

PRODUCT APPLICATOR AND METHOD OF PRODUCING SUCH AN APPLICATOR

FIELD

This application claims the benefits of priority of U.S. Provisional Application No. 60/391,090, filed Jun. 25, 2002, and U.S. Provisional Application No. 60/391,235, filed Jun. 26, 2002.

BACKGROUND

The present invention relates to a device for applying a product, such as, for example, a cosmetic product, for example a make-up product, and/or a care product. The product may be intended for application to a keratinous surface, which may be a surface on skin, fingernails, toenails, hair on an individual's head, eyelashes and/or eyebrows.

In the field of cosmetics and/or care products, it is desirable to find new effects. This may be especially true in the field of make-up where it often is desirable to obtain new aesthetic effects with respect to the body part that is being made up. As an example, in the field of applying mascara, it may be desirable to obtain effects that may, for example, add body, appear natural, be curve-improving, and/or be extending, or which may achieve a blend of such differing characteristics.

In some cases, the development of new applicator devices may be influenced by new make-up compositions which, due to their rheology, and other characteristics, may be difficult to apply with conventional applicators. Hence, many devices are developed with a goal toward producing new make-up effects and/or to facilitate the application of compositions having differing rheologies, for example.

By way of example, such devices may be distinguished from one another by the density and/or shape of their application elements (which may be in the form of fibers, for example), by their longitudinal and/or transverse profile, by the nature of the material of which the support and/or the application elements are composed, by the treatment to which all or part of the applicator device may be subjected, or by any other component of the overall packaging and applicator assembly of which the applicator device may be a constituent part (such as the wiper, for example).

French patent application No. 2 668 905 describes a method of obtaining a mascara brush which includes, after the brush has been twisted and sheared to the desired profile, heating the tips of the bristles to melt them. This creates small spherical bulges at the tips of the bristles resulting from the drawing together of the polymer material. After such treatment, the bristles are still substantially straight.

As another example, U.S. Pat. No. 5,161,554 describes a mascara brush of the twisted wire type, in which the section of the bristles varies along a longitudinal axis of the bristle. The bristles may be of an undulating shape. The result of this is that the bristles form curves having directions of concavity which alternate first in one direction and then in the other. The radius of curvature of the bristle may vary between a maximum radius and a minimum radius at each change of concavity direction.

U.S. Pat. No. 5,161,554 also describes a certain number of operations, for example, either during or after the extrusion of the bristles, that permit the desired profile to be achieved. After treatment, the bristles are laid out in the conventional way in the form of a layer which is inserted between the two wire strands obtained by of a U-shaped length of wire. The two wire strands are then twisted relative to one another to configure the bristles into an arrangement in the form of a multi-turn helix.

It has been found that, in forming conventional applicators, when deformations are produced during the process of extruding the bristles they may have, due to the extrusion process itself, a relatively large minimum curvature. When the deformations are the result of treatment after the extrusion, they may likewise have a relatively large minimum curvature, so as to facilitate handling the bristles by automated means in order to put them into the form of a layer for placing between the two strands of the U-shaped length of wire and to allow the two strands of the wire to be twisted.

It is also known to produce applicators, including, for example, mascara brushes, via molding. The mold may be designed so that the free ends of the application elements, which elements are, generally speaking, straight, terminate in a forked or hook-shaped portion. Because these end portions are formed by molding, their orientations relative to each other are predetermined. The results, from the point of view of making up, may be disappointing. Also, to achieve differing effects, it may be necessary to have a differing mold for each desired type of effect, which may increase the cost of manufacturing the device.

It also is known, in the case of mascara brushes, for example, for the free ends of the fibers to be ground and/or abraded so as to split them into multiple strands. Portions of bristles of a curved shape may result from a purely mechanical treatment of this kind. These curved portions may be, however, localized to the ends of the bristles. Also, it is difficult to bring the radius of curvature of the curved portions obtained down to below 50 mm. However, with radii of curvature of 50 mm or larger, the effects, as far as the resulting make-up is concerned, may be scarcely perceptible.

Therefore, it may be desirable to provide an applicator device, particularly for a cosmetic product, e.g. a make-up product and/or care product, which potentially solves at least one drawback of known devices.

For example, it may be desirable to provide a device for applying a cosmetic and/or care product which represents an alternative solution from the point of view of obtaining certain effects, and/or which affords the possibility of obtaining effects differing from the effects obtained with the conventional devices.

It also may be desirable to provide a device which is economical to make.

Further, it may be desirable to provide a method of producing an applicator, particularly for a care and/or cosmetic product, which is efficient and economical to produce in an industrial plant.

SUMMARY

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

As embodied and broadly described herein, one exemplary aspect of the invention includes a device for applying a product which may comprise a support and a plurality of polymeric fibers mounted to the support. Each of the plurality of fibers may have at least one free end and each of at least some of the fibers may define at least one curved portion extending continuously from the support to the free end. The curved portions may have an average radius of curvature that is less than approximately 45 mm and the curved portions of the at least some of the fibers may be randomly oriented relative to each other.

As referred to herein, the phrase "continuously" means with no reversal of the direction of the curvature (i.e., direction of concavity) between the support and the free end. In other words, a fiber having a "continuous" curved portion, as used herein, does not include a curved portion that undulates.

According to yet another exemplary aspect, a device for applying a product to a keratinous surface may comprise a support and a plurality of fibers extending from the support with each of the plurality of fibers having at least one free end. Each of at least some of the fibers may define at least one curved portion extending substantially from the support to the free end, and the curved portion may have a uniform direction of concavity. In other words, the concave surface of the curved portion faces the same direction throughout the length of the curved portion.

Yet another exemplary aspect includes a device comprising a support and a plurality of fibers extending from the support, each of the plurality of fibers having at least one free end. Each of at least some of the fibers may define at least one non-undulating curved portion extending substantially from the support to a free end.

In certain exemplary embodiments, the fibers may be in the form of bristles.

Curved portions of the types described above may be obtained, for example, by subjecting all or part of the applicator device to moderate heating. As an example, the heating may take place at a temperature which may be higher than the glass transition temperature of the material (e.g., a polymer) forming the said fibers which are desired to be curved. The heating also may occur at a temperature lower than the melting point of the said polymer for example, in the case of a semi-crystalline polymer.

The duration of the heating also may be adjusted to suit the material and the diameter of the fibers in such a way as to enable the desired curvature to be obtained, and without causing any drawing together of the material which, as described in the above-mentioned French patent application No. 2 688 905, may cause a substantial shortening of the fibers and may change their cross-section, particularly at their tips.

In some examples, when the average radius of curvature is above approximately 45 mm, the effects, for example in terms of make-up effects, may not be considered adequate and/or desirable. This may be especially true based on the rheology of the product to be applied.

In some embodiments, the relatively large curvature of the fibers, even assuming the density of the fibers to be high (for example, the number of fibers per turn in the case of a mascara brush of the twisted type) enables the gaps between two successive turns to be substantially reduced and increases the intermingling between the bristles. This may prevent the product, such as a make-up product, for example, from being applied in blobs.

By altering the radius of curvature of the fibers in conjunction with other parameters, such as the density of the fibers, their diameter, their cross-sectional shape, or the shape of the brush, for example, it may be possible to change from make-up which is very natural to make-up which is very heavy and/or, in the case of eyelashes, for example, to obtain greater or lesser amounts of extension or curved sweep.

For some embodiments, due to the degree of curvature, it also may be possible, in the case of an applicator intended for make-up, to obtain make-up effects which are new in comparison with the make-up effects obtained with conventional applicators, while using make-up compositions which are identical or substantially similar.

In some embodiments in the form of applicators for nail varnish and/or for a nail-care composition, which applicators may share some features in common with a paint brush, for example, the curvature of the fibers may help to space them away from one another, at least proximate the free end regions of the fibers, for example. This may permit an increase in the amount of product which can be held between the fibers. In this way, a single charge of the applicator with product may be sufficient to last a relatively long time during application of product before needing to recharge the applicator.

Also, due to this configuration of the tuft of fibers, mottled effects may be obtained on the nail.

Each of at least some of the fibers may have a substantially constant radius of curvature from the support to the corresponding free end. As used herein, "substantially constant" means a variation in the radius of curvature of at most approximately 15% from a mean value or, alternatively, at most approximately 10% from said mean value. The radius of curvature of a fiber may change to at least some extent along the length of the curved portion, in which case a mean radius of curvature may be determined. In an exemplary aspect, the mean radius of curvature of a curved portion of a fiber may be less than approximately 45 mm. When a fiber has a curved portion with an exactly constant radius of curvature (i.e., the radius of curvature does not change along the curved portion), the "mean" radius of curvature and the actual radius of curvature would be one and the same.

In accordance with an exemplary aspect, the applicator device may also be configured in the form of an arrangement of fibers which are substantially parallel relative to one another and extend substantially perpendicularly to an axis of the support. This arrangement may be similar to the arrangement of conventional toothbrushes, for example. Such applicators may be used in combination with a product prepared in the form of a solid cake, which has to be moistened before use, for example.

According to an exemplary aspect, the average radius of curvature of the curved portions may range from approximately 2 mm to approximately 40 mm. For example, the average may range from approximately 2 to approximately 30 mm. The range may be from approximately 3 mm to approximately 20 mm, or may be from approximately 3 mm to approximately 10 mm. The average radius of curvature of the curved portions may be determined by calculating an average for the mean radii of curvature for curved portions of at least two bristles.

According to an exemplary aspect, the mean radius of curvature of an individual curved portion may be less than approximately 45 mm, for example the mean radius of curvature may range from approximately 2 mm to approximately 40 mm. The mean radius of curvature may further range from approximately 2 to approximately 30 mm, for example, approximately 3 mm to approximately 20 mm and/or from approximately 3 mm to approximately 10 mm.

As an example, the fibers may be made from thermoplastics, such as, for example, a polyamide, or from thermoplastic elastomers. The thermoplastic material may be fully amorphous or semi-crystalline, for example. As an example, the fibers may be made of polyamide 6s, such as those marketed under the Tynex®) trademark, for example.

The diameter of the fibers may range from approximately 6/100ths of a millimeter to approximately 35/100ths of a millimeter. For example, the diameter of the fibers may range from approximately 10/100ths of a millimeter to approximately 25/100ths of a millimeter. For fibers that do not have a circular cross-section, the term "diameter" refers to a circle circumscribing the non-circular cross-section.

In an exemplary embodiment, the device comprises substantially straight fibers or substantially straight portions of fibers. As an example, the fibers defining curved portions also may have straight portions, which may extend from the support to a free end of the fiber opposite to the free end to which the curved portion extends, for example.

According to yet another exemplary aspect, the device may comprise a first group of fibers defining curved portions having a first average radius of curvature and a second group of fibers defining curved portions with a second average radius of curvature which differs from the first average radius of curvature. In an alternative, the second group of fibers may have substantially straight portions.

The differing average radii of curvature of the first and second groups may be the result of using first and second types of fibers, for example, fibers formed from differing materials and/or having differing glass transition temperatures.

Such differences also may be obtained with fibers formed from the same material. In this case, the thermal treatment conditions to which the fibers forming the two groups are subjected may differ, for example, in terms of temperature, length of heating, and/or other factors. Alternatively, or in addition, the curved portions of the first group may be portions of fibers whose diameter and/or shape may differ from the diameter and/or shape of the fibers from which the curved portions of the second group originate.

Hence, there may be used, alone or in mixtures, solid bristles, hollow bristles, bristles of circular, triangular, elongated or C-shaped cross-section or of a cross-section in the form of a four-leafed clover (quadrilobate). Of course, other shapes may be used too.

The various groups of fibers may, when they are mixed with one another, assist in producing effects for particular applications, such as producing desired make-up effects, for example. They may also, when they are separate from one another, be used for differing zones of a region to which product is being applied.

In an exemplary embodiment, the fibers may be oriented substantially transversely to a longitudinal axis of the support. In another exemplary embodiment, the fibers may be oriented substantially parallel to a longitudinal axis of the support.

The support may be formed by a twisted core. Such a core may be formed from two strands, for example, wire strands which are twisted relative to one another so as to hold the fibers between the two twisted strands. In this way, the fibers may extend radially from the twisted core and form a helical arrangement comprising a plurality of turns. The two wire strands may be obtained from a single length of wire folded substantially into a U or may be two separate lengths of wire placed next to and substantially parallel to one another.

In some exemplary embodiments including twisted wire cores, each fiber, which may be held in place substantially at its center by the twisted core, may comprise two portions, each of which extends from the support to a corresponding free end. Thus, in an exemplary embodiment, an applicator may comprise fibers in which both portions are curved and are of either differing or substantially the same curvature, fibers wherein one portion is curved and the other portion is straight, and fibers wherein both portions are straight, mixed with other fibers, as described above, or any other combination of fibers, for example.

The fibers may be arranged in a helical arrangement, with the number of bristles per turn ranging from approximately 5 to approximately 80, such as, for example from approximately 10 to approximately 45. The helical layout of the fibers may be perceptible to a greater or lesser degree, or indeed totally imperceptible, at the surface of the applicator as a function of the degree to which the fibers are curved and/or are randomly oriented relative to each other.

The cross-section of the applicator device as taken along a portion of the device containing the fibers may be circular, polygonal, for example, triangular, square or pentagonal, or any other desired shape, for example. Also, the twisted core may have a substantially straight or curved longitudinal axis.

The twisted core may have a plurality of turns which ascend from the left to the right when the brush is viewed side-on in a vertical position. When this is the case, the brush may be termed "anticlockwise twisted" (e.g., "counterclockwise twisted"). Alternatively, the twisted core may have a plurality of turns which ascend from the right to the left when the brush is viewed side-on in a vertical position. When this is the case, the brush may be termed "clockwise twisted". The twisted core also may have at least one portion that is anticlockwise twisted and at least one portion that is clockwise twisted.

In the case of an applicator having a plurality of groups of fibers with portions of differing radii of curvatures (e.g., including curved and/or straight portions), the fibers may be mixed with one another along the support. Alternatively, or in addition, differing groups of fibers may be separated from each other, for example by being separated along the longitudinal axis of the support such that one group of fibers extends from a first length of the support and another group of fibers extends from a second length of the support. Alternatively or in addition, the differing groups of fibers may be separated angularly around the support. For example, a first group of fibers may extend around a first angular section of the support and a second group of fibers may extend around a second angular section of the support.

According to an exemplary aspect, the ends of the fibers opposite the free ends may be mounted to the support. Alternatively, portions of the fibers between the ends of the fibers may be mounted to the support. Also, the fibers may be oriented either substantially parallel to or substantially perpendicular to a longitudinal axis of the support.

The applicator device, according to an exemplary aspect, may be configured to apply a product to a keratinous surface, which may be a surface on fingernails, toenails, hair on an individual's head, eyebrows, eyelashes, and/or skin, for example. The device may be configured to apply a cosmetic product, for example a make-up product, and/or a care product. The make-up product may be mascara and/or nail varnish, for example. In an exemplary aspect, the product to be applied does not include toothpaste.

According to another exemplary aspect of the invention, a method of producing a device for applying a product may comprise mounting a plurality of polymeric fibers to a support. The method may further comprise heating at least some of the fibers to a temperature higher than a glass transition temperature of the polymeric fibers. The heating may occur for a time period sufficient for at least some of the fibers to form curved portions without substantially changing a length of the fibers.

In the case of a semi-crystalline material, for example, the fibers may be heated to a temperature substantially lower than the melting point of the material from which they are formed.

The heating of the fibers may be carried out by convection heating, such as, for example, by immersing the fibers in a heated liquid, by contacting the fibers with hot air, and/or by radiating the fibers. In the latter case, infrared radiation may be used, for example.

As another example, the heating may be performed by immersing the fibers in liquid (e.g., water) having a temperature of approximately 100° C. Such a temperature may be satisfactory for polyamide 6 fibers which have a glass transition temperature ranging from about 50° C. to about 60° C. and a melting point on the order of 185° C.

The fibers may be immersed in the liquid for a length of time ranging from about 4 to about 25 seconds. For example, the fibers may be immersed from about 7 seconds to about 15 seconds.

By way of example, for a twisted brush comprising polyamide 6 fibers having a diameter of about 13/100ths of a millimeter, the maximum curvature may be obtained after approximately 8 seconds of heating in water at 100° C.

In another exemplary aspect, the heating of the fibers may occur after the mounting of the fibers.

According to yet another exemplary aspect, a system for applying a product may comprise any of the devices described above and a reservoir configured to contain the product to be applied.

The system may further comprise the product in the reservoir. The product may be a cosmetic and/or care product configured for application to a keratinous surface, for example.

In an exemplary aspect, the system may also comprise a wiper through which the device is configured to pass, at least when it is withdrawn from the holder. The wiper may enable the amount of product present on, or between, the fibers to be metered by wiping off excess product.

The device may further comprise a closure member configured to close the reservoir. The closure member may also be used for grasping the applicator device.

BRIEF DESCRIPTION OF THE DRAWINGS

Besides the structural and procedural arrangements set forth above, the invention could include a number of other arrangements, such as those explained hereinafter. It is to be understood that both the foregoing description and the following description are exemplary.

The accompanying drawings are included to provide a further understanding of the invention and are incorporated in and constitute a part of this specification. The drawings illustrate exemplary embodiments of the invention and, together with the description, serve to explain certain principles. In the drawings.

DETAILED DESCRIPTION OF EXEMPLARY EMBODIMENTS

Figure 1:
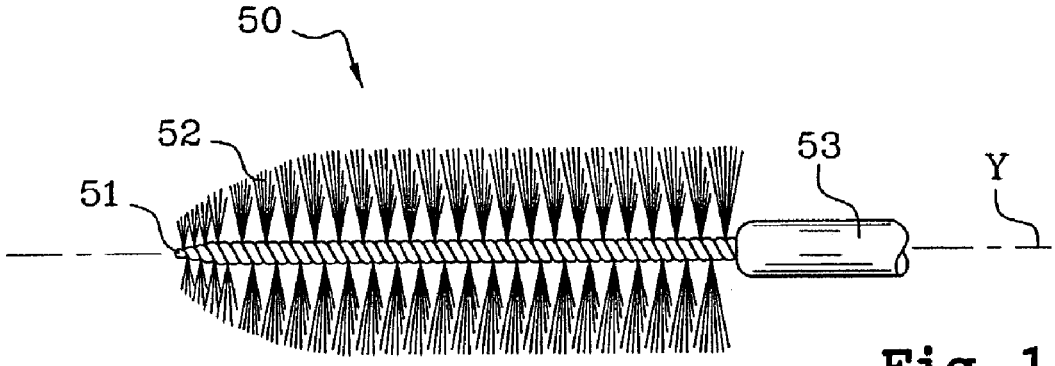
Fig. 1 (PRIOR ART)
FIG. 1 is a partial schematic view of a conventional applicator of the twisted brush type.

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes and/or superscripts are used to refer to similar parts.

FIG. 1 shows a conventional brush 50 of the twisted wire type, as currently may be used for applying a product, such as make-up to eyelashes or eyebrows, for example. The brush 50 comprises a twisted core 51 which is obtained from a length of wire which is folded substantially into a U and between which, prior to the twisting motion, a layer of bristles 52 is inserted. In response to a twisting motion, the bristles 52 are grasped between the wire strands and arranged in a helical configuration formed by a succession of turns spaced a greater or lesser distance apart depending on the degree of twist. The bristles 52 extend radially from the support formed by twisting the wire strands. The bristles are substantially straight or at least have a large radius of curvature (greater than approximately 60 mm, for example).

A bristleless portion of the twisted core 51 may be fitted to a rod 53. The end of the rod 53 opposite from the brush 50 may be connected to a component (not shown) which may form a member for holding the brush 50 and/or a closure member for closing a reservoir with which the brush may be associated.

Figure 2:
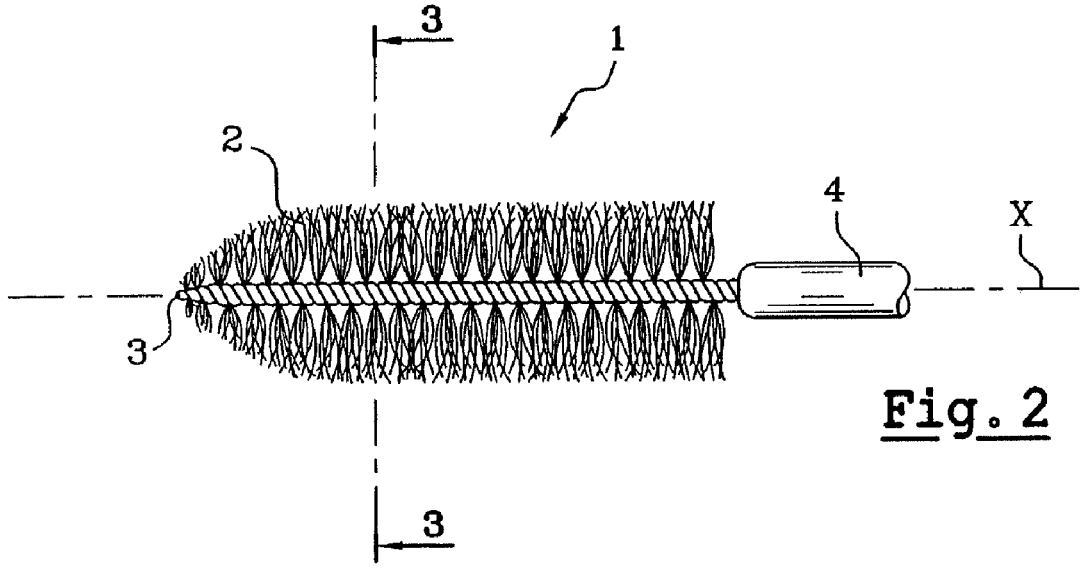
FIG. 2 is a partial schematic view of an applicator device according to an exemplary embodiment.

FIG. 2 shows a brush 1 having similar features to that shown in FIG. 1 but altered in accordance with exemplary aspects of the invention. In this exemplary embodiment, and similar to the brush 50 shown in FIG. 1, the brush 1 is of the "anticlockwise twisted" type since the turns of the twisted core 3 ascend from left to right when the brush 1 is viewed side-on in a vertical position.

In the same way as in the case of the brush shown in FIG. 1, a bristleless part of the twisted core 3 may be fixed to the end of a rod 4. The twisted core 3 of the brush may be substantially straight and may extend along an axis X corresponding to the axis of the rod 4.

The bristles 2 of the brush, unlike the bristles 52 of the brush in FIG. 1 define curved portions. The curved portions may extend over substantially the entire length of the bristle 2, as shown in FIG. 2 (e.g., each of at least some of the bristles may include a first curved portion associated with one free end and a second curved portion associated with an opposite free end). According to an exemplary configuration, each curved portion may have a mean radius of curvature which ranges from approximately 3 mm to approximately 10 mm, for example.

In accordance with an exemplary aspect, the radius of curvature of the curved portion of a fiber (e.g., a bristle) may be measured with a profile projector at an enlargement of 10, for example. The profile projector may be a profile projector which is sold under the trade name H562 by the HAUSER® company, for example. Such a profile projector may be used to measure the mean radius of curvature of the curved portion.

Other methods also may be used to measure the mean radius of curvature of a curved portion of a fiber. For example, the curved portion may be partitioned into at least two sections or more, such as ten, for example, which may be of approximately equal length, and the radius of curvature for each section may be determined. The radius of curvature for each section may be determined using a profile projector such as that discussed above and/or via other techniques known for measuring a radius of curvature. After measuring the radius of curvature for each section, the mean of those radii can be calculated to determine the mean radius of curvature. Of course it should be understood that any number of partitions could be utilized, with the accuracy of the mean radius of curvature improving as the number of partitions increases.

To determine the average radius of curvature of a group of curved portions, the mean radius of curvature of each curved portion in the group may be determined using any of the techniques described above and then an average for the group calculated. For example, if one curved portion has a mean radius of curvature of 10 mm and another curved portion has a mean radius of curvature of 20 mm, the average radius of curvature for those curved portions would be 15 mm.

The curved portions of the fibers shown in FIG. 2 may be randomly oriented relative to one another. In an exemplary embodiment, the thermal treatment to which the fibers are subjected may cause a curvature of each curved portion which is substantially constant from the support to the free end.

Figure 11:
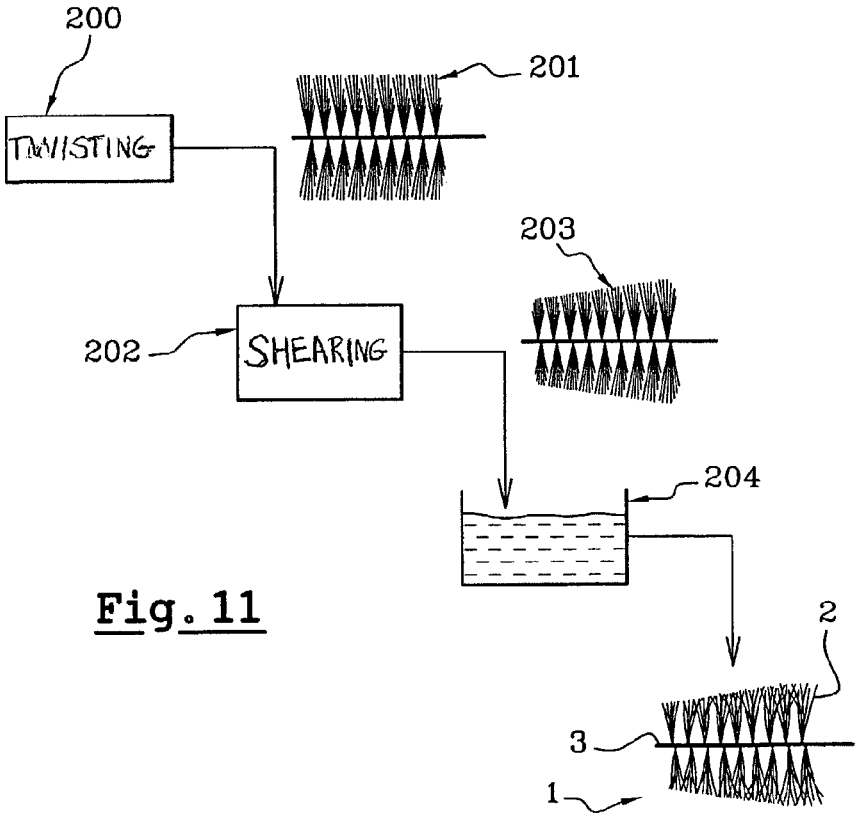
FIG. 11 is a schematic representation of various stages of an exemplary method for making an embodiment of an applicator device.

FIG. 11, to which reference will now be made, shows schematically some exemplary steps that may be carried out during production of a brush 1 of the type shown in FIG. 2, for example.

In a first exemplary step 200, the bristles may be inserted, in the form of a layer, for example, between the two strands of wire (not shown separately in FIG. 11), which are then twisted. The result is a substantially cylindrical twisted wire brush 201 which may be, for example, approximately 15 mm in diameter at the bristled portion.

The brush 201 may then be sheared (step 202) to give it a profile as desired based on the application. As an example, the brush 201 may be sheared so as to obtain a frusto-conical profile, as shown in FIG. 11. Of course, other profiles may be desired and the brush 201 may be sheared accordingly. The diameter of the resulting brush 203, at its wider end, may range from approximately 7 mm to approximately 8 mm. The bristles of the brush 203 may be substantially straight.

In the next step 204, the brush 203 may be immersed in liquid, such as water, having a temperature of about 100° C. According to an exemplary aspect, the brush may be immersed for approximately 8 seconds. The result of step 204, as shown in FIG. 11, may be a shaping of the bristles which may produce curved portions having an average radius of curvature on the order of about 3 mm to about 10 mm.

The brush 1 produced by the process described with reference to FIG. 11 may have turns which are barely, if at all, visible when the brush is viewed from the side. This may be due to the effect of the intermingling caused by the randomly oriented curved portions of the treated bristles 2.

In an exemplary embodiment, the bristles may be substantially circular in cross-section. Their diameter may be on the order of approximately 13/100ths of a millimeter. Further, the bristles may be made of polyamide 6. As an example, the brush may have about 23 to 25 bristles per helical turn.

Figure 3A:
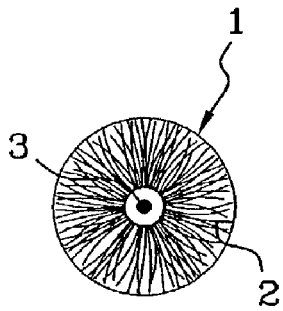
FIGS. 3A to 3C are cross-sectional views of various exemplary embodiments of an applicator device according to the invention wherein the views are taken along plane 3—3 of FIG. 2.
Figure 3B:
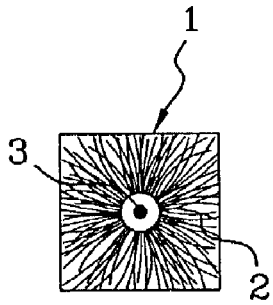
Figure 3C:
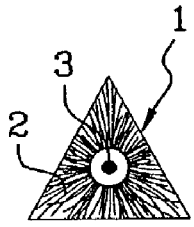

A cross-section through the bristled portion of the brush 1 perpendicular to the axis X may be, as shown in the exemplary embodiment of FIG. 3A, substantially circular in shape. In another exemplary embodiment shown in FIG. 3B, the cross-section of the brush 1 may be square. In still another exemplary embodiment shown in FIG. 3C, the cross-section of the brush 1 may be triangular. Other cross-sectional shapes of the bristled portion of the brush 1 may also be used and are envisioned as being within the scope of this invention. The various shapes may be obtained by shearing the brush, as described with reference to FIG. 11, for example.

Figure 4A:
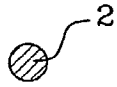
FIGS. 4A to 4F are cross-sectional views of various exemplary embodiments of fibers according to the invention.
Figure 4B:
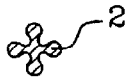
Figure 4C:
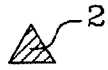
Figure 4D:
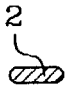
Figure 4E:
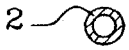
Figure 4F:
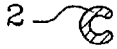

The cross-section of the bristles 2 also may be of various shapes. For example, in FIG. 4A, the bristles 2 are solid and substantially circular in section. In FIG. 4B, the bristles 2 have a section in the shape of a four-leafed clover. In FIG. 4C, the bristles 2 are triangular in cross-section. In FIG. 4D, the bristles 2 have a section in the shape of a grain of rice. In FIG. 4E, the bristles 2 are hollow and annular in section. In FIG. 4F, the bristles 2 have C-shaped cross-sections. Of course, the bristles may have any cross-sectional configuration and the cross-sections shown in FIGS. 4A–4F are exemplary only.

Moreover, the brush 1 may comprise bristles 2 having only one type of cross-section, or may comprise a mixture of bristles having differing cross-section, and/or other configurations.

Figure 5:
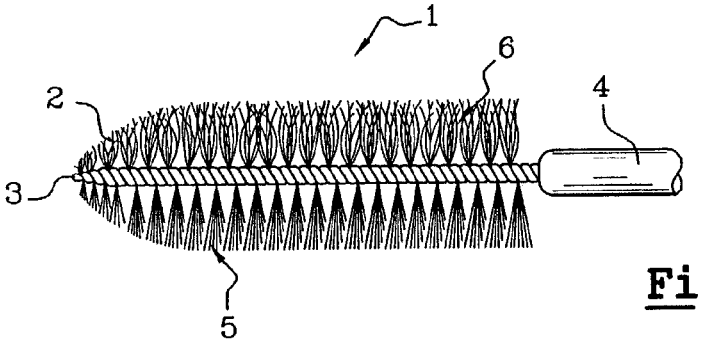
FIG. 5 is a partial schematic view of another exemplary embodiment of an applicator device.

In the exemplary embodiment shown in FIG. 5, only a part of the brush 1 has been subjected to a thermal treatment, such as the thermal treatment represented by step 204 in FIG. 11. In FIG. 5, the bristles 2 that are situated on one and the same side of a plane bisecting the twisted core 2 have been subjected to the thermal treatment and thus define curved portions that extend substantially from the support to a free end of the bristle.

By subjecting only a portion of the brush 1 to the heat treatment, a portion 5 of the brush 1 extending for approximately 180° around the twisted core 3 has straight bristle portions and the remainder of the brush 6 has curved bristle portions 2. The portions 5 and 6 may each extend for the entire length of the brush 1, for example, as shown in FIG. 5.

In an exemplary method of using the device of FIG. 5, the portion 5 may be used for applying product to the eyelashes, and the portion 6 may be used for separating the eyelashes.

Figure 6:
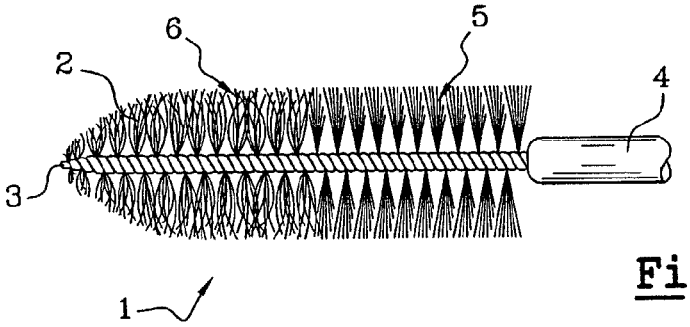
FIG. 6 is a partial schematic view of an applicator device according to yet another exemplary embodiment.

In the exemplary embodiment of FIG. 6, once again only a portion of the brush has been subjected to a thermal treatment. Referring to FIG. 6, an axial portion of the brush 1 which is situated at the opposite end from the rod 4 has been subjected to a thermal treatment, such as that represented by step 204 in FIG. 11, for example. The result is a brush 1 which, over a first axial portion 5 extending for approximately half the length of the brush 1, has straight bristles 2. Over the remaining axial portion 6, the bristles 2 are curved. Similar to the description of the previous embodiment, portion 5 may be used for applying product to the eyelashes, and portion 6 may be used for separating the eyelashes. It should be understood that the relative axial lengths covered by portions 5 and 6 can vary as desired based on the particular application and other factors.

Figure 7:
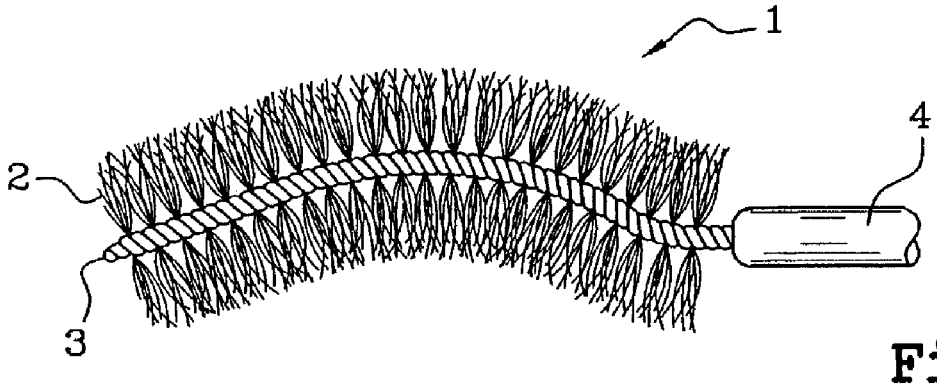
FIG. 7 is a partial schematic view of an applicator device according to another exemplary embodiment.

The exemplary brush 1 which is shown in FIG. 7 differs from the brush shown in FIG. 2 in that the twisted core 3 has a curved longitudinal axis. In an exemplary embodiment, the curvature of the core's longitudinal axis may correspond substantially to the line along which the eyelashes are positioned in the eyelid, for example.

Figure 8:
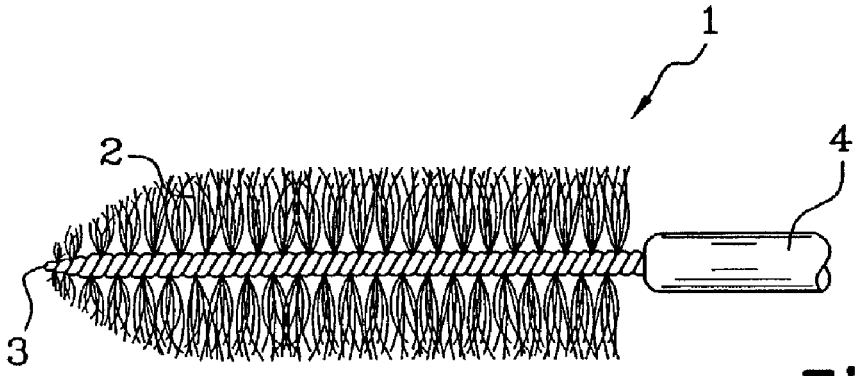
FIG. 8 is a partial schematic view of an applicator device according to yet a further exemplary embodiment.

The exemplary brush shown in shown in FIG. 8 differs from the brush shown in FIG. 2 in that it is of the "clockwise twisted" brush type, with the turns of the twisted core 3 ascending from right to left when the brush 1 is viewed side-on in a vertical position. In this way, the type of make-up obtained may differ from that obtained with the brush shown in FIG. 2, which is "anti-clockwise twisted."

Figure 9:
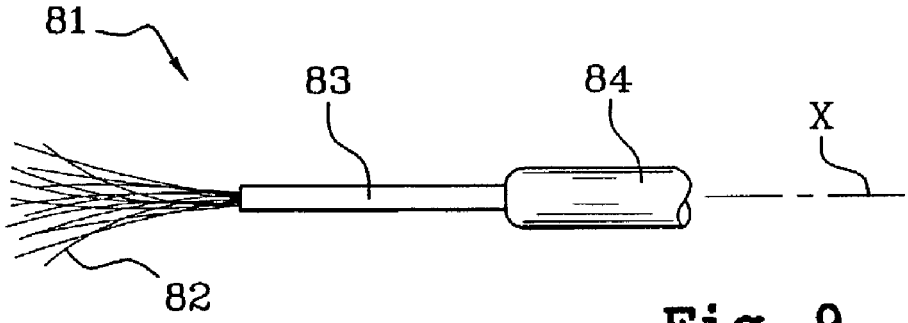
FIG. 9 is a partial schematic side view of an applicator device according to another exemplary embodiment.

In the exemplary embodiment shown in FIG. 9, the applicator device 81 is configured in the form of a brush configured for applying varnish to the nails. It comprises a tuft of bristles 82 clipped into the end of a rod 83 having an axis X. The bristles 82 are orientated substantially parallel to the axis X (angle to the axis X of less than 45°). The tuft of bristles 82 may be formed of a plurality of bristles folded substantially in half, with the folded portions being mounted to the rod 83. Alternatively, the bristles 82 may be connected to the rod 83 at their ends.

The end of the rod 83 opposite from the tuft of bristles 82 may be connected to a component 84 which forms both a member for gripping the brush 81 and a member for closing and/or sealing the reservoir with which the brush 81 is associated. The curvature of the hairs 82 of the brush 81 may be obtained in the same way as the curvature of the bristles of the mascara brushes in the previous figures. For example, the curvature may be obtained by immersing the brush 81, or at least a portion of the brush, for approximately ten or so seconds in liquid (e.g., water) at a temperature of approximately 100° C.

Due to the curvature of the bristles 82, more product may be held by the brush than would be the case if the bristles were straight. This may be due to the increased separation between the bristles 82 that occurs from forming the curved portions. By increasing the amount of product held by the bristles 82, the time for which one charge of the brush lasts before needing to recharge the brush with product may be improved.

Figure 10:
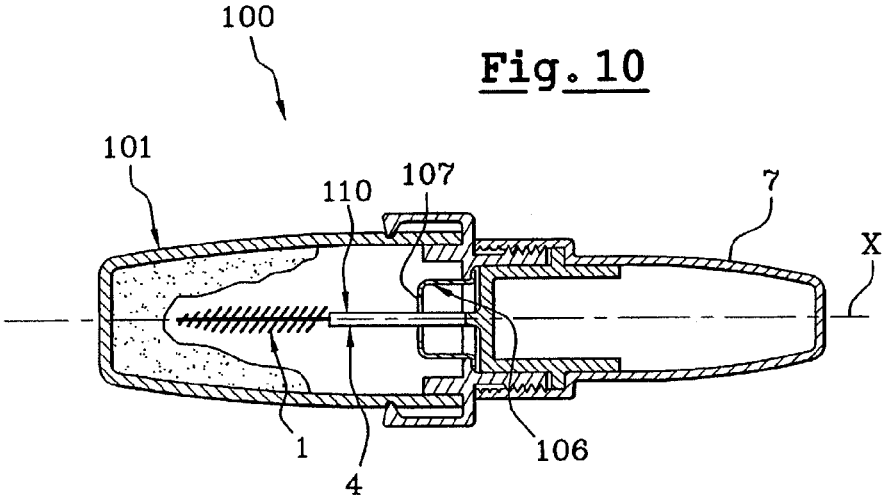
FIG. 10 is a schematic partial cross-sectional view of an exemplary embodiment of an application assembly.

FIG. 10 shows an exemplary embodiment of a system 100 for applying and packaging a product. The assembly 100 may further comprise a reservoir 101 which contains a supply of a product to be applied, such as mascara, for example, and an applicator 110. The applicator 110 may include an applicator device 1 of any of the types described above with reference to FIGS. 2 to 8, for example. The applicator 110 comprises an applicator device 1 of the twisted brush type which is fixed to one end of a rod 4 having an axis X. The other end of the rod 4 may be secured to a member for gripping 7 which also forms a cap for closing and/or sealing off the reservoir 101.

In an exemplary embodiment, the reservoir 101 may comprise a wiper member 106 which is formed in this case by a cylindrical sleeve which terminates at one end in a flexible annular lip 107. In the position where the applicator 110 is fitted to the reservoir 101, substantially the whole portion 1 of the applicator 110 is situated between the wiping lip 107 and the end wall of the reservoir 101. Other types of wiping members may be used, such as a block of open-celled or semi-open-celled foam, for example, through which there may pass an axially a slot or passage having defining edges are substantially in contact with one another when no stress is applied.

To use the applicator, the user may unscrew the cap formed by the member 7 for gripping and may withdraw the applicator 110 from the reservoir 101. When this is done, the portion 1 of the applicator is caused to pass through the wiping device 106 in such a way as to meter the amount of product distributed over the fibers (e.g., bristles.) The direction of the movement by which the applicator is withdrawn is substantially longitudinal to the axis X. After use, the user may replace the applicator 110 in the reservoir 101 by again causing the portion 1 to pass through the wiping member 106.

Though the various devices, systems, and methods disclosed have been described in conjunction with their use for applying mascara and nail varnish, it is contemplated that the devices, systems, and methods could be utilized in the application of a variety of other types of products, including a variety of cosmetic and/or care and/or make-up products. Furthermore, the sizes of various structural parts and materials used to make these parts are illustrative and exemplary only and one of ordinary skill in the art would recognize that these materials and sizes can be changed as necessary to produce different effects or desired characteristics of the applicator device. Moreover, the temperatures and time periods set forth with respect to the method of making the device may be altered as needed based on such factors as the desired curvature, the type of material from which the fibers and/or the support are made, and other factors that may influence the heating.

It will be apparent to those skilled in the art that various modifications and variations can be made to the structure and methodology. Thus, it should be understood that the invention is not limited to the examples discussed in the specification. Rather, the present invention is intended to cover modifications and variations.

What is claimed is:

1. A device for applying a product, the device comprising:

a support; and a plurality of polymeric fibers mounted to the support, each of the plurality of fibers having at least one free end, wherein each of at least some of the fibers defines at least one curved portion extending continuously from the support to the free end, wherein the curved portions have an average radius of curvature that is less than approximately 45 mm, and wherein curved portions of said at least some of the fibers are randomly oriented relative to each other.

2. The device of claim 1, wherein at least one of the curved portions has a substantially constant curvature from the support to the free end.

3. The device of claim 1, wherein the average radius of curvature ranges from approximately 2 mm to approximately 40 mm.

4. The device of claim 3, wherein the average radius of curvature ranges from approximately 2 mm to approximately 30 mm.

5. The device of claim 4, wherein the average radius of curvature ranges from approximately 3 mm to approximately 20 mm.

6. The device of claim 5, wherein the average radius of curvature ranges from approximately 3 mm to approximately 10 mm.

7. The device of claim 1, wherein the fibers are made of a material chosen from thermoplastics and thermoplastic elastomers.

8. The device of claim 7, wherein the fibers are made of a polyamide material.

9. The device of claim 1, wherein the fibers have a diameter ranging from approximately 6/100 mm to approximately 35/100 mm.

10. The device of claim 9, wherein the fibers have a diameter ranging from approximately 10/100 mm to approximately 25/100 mm.

11. The device of claim 1, wherein the plurality of fibers comprise fibers that are substantially straight.

12. The device of claim 1, wherein each of the at least some fibers defines a substantially straight portion.

13. The device of claim 12, wherein the substantially straight portion extends from the support to a free end of the fiber opposite to the free end to which the curved portion extends.

14. The device of claim 1, wherein the at least some fibers comprise a first group of fibers defining curved portions having a first average radius of curvature and a second group of fibers defining curved portions having a second average radius of curvature that differs from the first average radius of curvature and/or having substantially straight portions.

15. The device of claim 14, wherein the first group of fibers are mixed with the second group of fibers.

16. The device of claim 14, wherein the first group of fibers are separated from the second group of fibers.

17. The device of claim 16, wherein the first group of fibers extends along a first length of the support and the second group of fibers extends along a second length of the support that differs from the first length.

18. The device of claim 16, wherein the first group of fibers extends around a first angular section of the support and the second group of fibers extends around a second angular section of the support that differs from the first angular section.

19. The device of claim 14, wherein the first group of fibers and the second group of fibers are made of differing materials.

20. The device of claim 19, wherein the differing materials have differing glass transition temperatures.

21. The device of claim 14, wherein the first group of fibers and the second group of fibers are made of the same material.

22. The device of claim 1, wherein the fibers are oriented substantially transversely to a longitudinal axis of the support.

23. The device of claim 1, wherein the support comprises wire strands twisted about each other to form a twisted core.

24. The device of claim 23, wherein the twisted core comprises a plurality of turns that ascend from the left to the right when the device is viewed side-on in a vertical position.

25. The device of claim 23, wherein the twisted core comprises a plurality of turns that ascend from the-right to the left when the device is viewed side-on in a vertical position.

26. The device of claim 23, wherein the fibers are held between the twisted strands and extend radially relative to the twisted core.

27. The device of claim 1, wherein the device is configured to apply a product to a keratinous surface.

28. The device of claim 27, wherein the keratinous surface is on at least one of hair on an individual's head, skin, fingernails, toenails, eyelashes, and eyebrows.

29. The device of claim 28, wherein the device is configured to apply mascara.

30. The device of claim 1, wherein the fibers are arranged in a helical arrangement comprising a plurality of turns.

31. The device of claim 30, wherein the number of fibers per turn ranges from approximately 5 to approximately 80.

32. The device of claim 31, wherein the number of fibers per turn ranges from approximately 10 to approximately 45.

33. The device of claim 1, wherein a cross-section of a portion of the device formed by the support and the plurality of fibers is chosen from circular and/or polygonal.

34. The device of claim 33, wherein a cross-section of a portion of the device formed by the support and the plurality of fibers is chosen from triangular, square, and/or pentagonal.

35. The device of claim 1, wherein the support has a substantially straight longitudinal axis.

36. The device of claim 1, wherein the support has a curved longitudinal axis.

37. The device of claim 1, wherein the fibers are oriented substantially parallel to a longitudinal axis of the support.

38. The device of claim 37, wherein ends of the fibers opposite the free ends are mounted to the support.

39. The device of claim 1, wherein the fibers are in the form of bristles.

40. A method of making a device for applying a product, the method comprising:

mounting a plurality of polymeric fibers to a support;

heating at least some of the fibers to a temperature higher than a glass transition temperature of the polymeric fibers, wherein the heating occurs for a time period sufficient for at least some of the fibers to form curved portions without substantially changing a length of the fibers.

41. The method of claim 40, wherein the heating comprises convection heating.

42. The method of claim 41, wherein the heating comprises immersing the at least some fibers in a heated liquid, contacting the at least some fibers with hot air, and/or radiating the at least some fibers.

43. The method of claim 42, wherein the heating comprises radiating the at least some fibers via infrared radiation.

44. The method of claim 42, wherein the heating comprises immersing the at least some fibers in liquid having a temperature of approximately 100° C.

45. The method of claim 44, wherein the immersing comprises immersing the at least some fibers for a length of time ranging from approximately 4 seconds to approximately 25 seconds.

46. The method of claim 45, wherein the immersing comprises immersing the at least some fibers for a length of time ranging from approximately 7 seconds to approximately 15 seconds.

47. The method of claim 41, wherein the heating of the at least some fibers occurs after the mounting of the fibers.

48. A system for applying a product, the system comprising:

the device of claim 1; and a reservoir configured to contain the product to be applied.

49. The system of claim 48, further comprising a product contained in the reservoir.

50. The system of claim 49, wherein the product is a cosmetic and/or care product configured for application to a keratinous surface.

51. The system of claim 50, wherein the product comprises a make-up product.

52. The system of claim 50, wherein the keratinous surface is on at least one of hair on an individual's head, fingernails, toenails, skin, eyelashes, and eyebrows.

53. The system of claim 49, wherein the product is mascara.

54. The system of claim 48, wherein the device further comprises a closure member configured to close the reservoir.

55. A device for applying a product to a keratinous surface, the device comprising:

a support; and a plurality of fibers extending from the support, each of the plurality of fibers having at least one free end, wherein the support comprises wire strands twisted about each other to form a twisted core, wherein each of at least some of the fibers defines at least one curved portion extending substantially from the support to the free end, wherein the curved portion has a uniform direction of concavity, and wherein the device is configured to apply a product to at least one of eyelashes, eyebrows, and fingernails.

56. The device of claim 55, wherein at least one of the curved portions has a substantially constant radius of curvature from the support to the free end.

57. The device of claim 55, wherein the curved portions have an average radius of curvature of less than approximately 45 mm.

58. The device of claim 55, wherein the fibers are made of a material chosen from thermoplastics and thermoplastic elastomers.

59. The device of claim 58, wherein the fibers are made of a polyamide material.

60. The device of claim 55, wherein the fibers have a diameter ranging from approximately 6/100 mm to approximately 35/100 mm.

61. The device of claim 55, wherein the plurality of fibers comprise fibers that are substantially straight.

62. The device of claim 55, wherein each of the at least some fibers defines a substantially straight portion.

63. The device of claim 62, wherein the substantially straight portion extends from the support to a free end of the fiber opposite to the free end to which the curved portion extends.

64. The device of claim 55, wherein the at least some fibers comprise a first group of fibers defining curved portions having a first average radius of curvature and a second group of fibers defining curved portions having a second average radius of curvature that differs from the first average radius of curvature and/or having substantially straight portions.

65. The device of claim 64, wherein the first group of fibers are mixed with the second group of fibers.

66. The device of claim 64, wherein the first group of fibers are separated from the second group of fibers.

67. The device of claim 66, wherein the first group of fibers extends along a first length of the support and the second group of fibers extends along a second length of the support that differs from the first length.

68. The device of claim 66, wherein the first group of fibers extends around a first angular section of the support and the second group of fibers extends around a second angular section of the support that differs from the first angular section.

69. The device of claim 64, wherein the first group of fibers and the second group of fibers are made of differing materials.

70. The device of claim 69, wherein the differing materials have differing glass transition temperatures.

71. The device of claim 64, wherein the first group of fibers and the second group of fibers are made of the same material.

72. The device of claim 55, wherein the fibers are oriented substantially transversely to a longitudinal axis of the support.

73. The device of claim 55, wherein the fibers are held between the twisted strands and extend radially relative to the twisted core.

74. The device of claim 55, wherein the device is configured to apply a product to a keratinous surface.

75. The device of claim 74, wherein the keratinous surface is on at least one of hair on an individual's head, skin, fingernails, toenails, eyelashes, and eyebrows.

76. The device of claim 75, wherein the device is configured to apply mascara.

77. The device of claim 55, wherein the fibers are arranged in a helical arrangement.

78. The device of claim 55, wherein a cross-section of a portion of the device formed by the support and the plurality of fibers is chosen from circular and/or polygonal.

79. The device of claim 78, wherein a cross-section of a portion of the device formed by the support and the plurality of fibers is chosen from triangular, square, and/or pentagonal.

80. The device of claim 55, wherein the fibers are oriented substantially parallel to a longitudinal axis of the support.

81. The device of claim 80, wherein ends of the fibers opposite the free ends are mounted to the support.

82. The device of claim 55, wherein the fibers are in the form of bristles.

83. The device of claim 55, wherein the curved portions of the at least some fibers are randomly oriented relative to each other.

84. The device of claim 55, wherein the fibers are made of a polymeric material.

85. A system for applying a product, the system comprising:

a device for applying a product to a keratinous surface comprising a support; and a plurality of fibers extending from the support, each of the plurality of fibers having at least one free end, wherein each of at least some of the fibers defines at least one curved portion extending substantially from the support to the free end, and wherein the curved portion has a uniform direction of concavity; and a reservoir configured to contain the product to be applied.

86. The system of claim 85, further comprising a product contained in the reservoir.

87. The system of claim 86, wherein the product is a cosmetic and/or care product configured for application to a keratinous surface.

88. The system of claim 87, wherein the product comprises a make-up product.

89. The system of claim 87, wherein the keratinous surface is on at least one of hair on an individual's head, fingernails, toenails, skin, eyelashes, and eyebrows.

90. The system of claim 87, wherein the product is mascara.

91. The system of claim 85, wherein the device further comprises a closure member configured to close the reservoir.

92. A device for applying a product to a keratinous surface, the device comprising:

a support; and a plurality of fibers extending from the support, each of the plurality of fibers having at least one free end, wherein the support comprises wire strands twisted about each other to form a twisted core, wherein each of at least some of the fibers defines at least one non-undulating curved portion extending substantially from the support to a free end, and wherein the device is configured to apply a product to at least one of eyelashes, eyebrows, and fingernails.

93. The device of claim 92, wherein at least one of the curved portions has a substantially constant curvature from the support to the free end.

94. The device of claim 92, wherein the curved portion has an average radius of curvature of less than approximately 45 mm.

95. The device of claim 92, wherein the fibers are made of a material chosen from thermoplastics and thermoplastic elastomers.

96. The device of claim 95, wherein the fibers are made of a polyamide material.

97. The device of claim 92, wherein the fibers have a diameter ranging from approximately 6/100 mm to approximately 35/100 mm.

98. The device of claim 92, wherein the plurality of fibers comprise at least some fibers that are substantially straight.

99. The device of claim 92, wherein each of the at least some fibers defines a substantially straight portion.

100. The device of claim 99, wherein the substantially straight portion extends from the support to a free end of the fiber opposite to the free end to which the curved portion extends.

101. The device of claim 92, wherein the at least some fibers comprise a first group of fibers defining curved portions having a first average radius of curvature and a second group of fibers defining curved portions having a second average radius of curvature that differs from the first average radius of curvature and/or having substantially straight portions.

102. The device of claim 101, wherein the first group of fibers are mixed with the second group of fibers.

103. The device of claim 101, wherein the first group of fibers are separated from the second group of fibers.

104. The device of claim 103, wherein the first group of fibers extends along a first length of the support and the second group of fibers extends along a second length of the support that differs from the first length.

105. The device of claim 103, wherein the first group of fibers extends around a first angular section of the support and the second group of fibers extends around a-second angular section of the support that differs from the first angular section.

106. The device of claim 101, wherein the first group of fibers and the second group of fibers are made of differing materials.

107. The device of claim 106, wherein the differing materials have differing glass transition temperatures.

108. The device of claim 101, wherein the first group of fibers and the second group of fibers are made of the same material.

109. The device of claim 92, wherein the fibers are oriented substantially transversely to a longitudinal axis of the support.

110. The device of claim 92, wherein the fibers are held between the twisted strands and extend radially relative to the twisted core.

111. The device of claim 92, wherein the device is configured to apply a product to a keratinous surface.

112. The device of claim 111, wherein the keratinous surface is on at least one of hair on an individual's head, skin, fingernails, toenails, eyelashes, and eyebrows.

113. The device of claim 112, wherein the device is configured to apply mascara.

114. The device of claim 92, wherein the fibers are arranged in a helical arrangement.

115. The device of claim 92, wherein a cross-section of a portion of the device formed by the support and the plurality of fibers is chosen from circular and/or polygonal.

116. The device of claim 115, wherein a cross-section of a portion of the device formed by the support and the plurality of fibers is chosen from triangular, square, and/or pentagonal.

117. The device of claim 92, wherein the fibers are oriented substantially parallel to a longitudinal axis of the support.

118. The device of claim 117, wherein ends of the fibers opposite the free ends are mounted to the support.

119. The device of claim 92, wherein the fibers are in the form of bristles.

120. The device of claim 92, wherein the curved portions of the at least some fibers are randomly oriented relative to each other.

121. The device of claim 92, wherein the fibers are made of a polymeric material.

122. A system for applying a product, the system comprising:

a device for applying a product to a keratinous surface comprising a support; and a plurality of fibers extending from the support, each of the plurality of application elements having at least one free end, wherein each of at least some of the fibers defines at least one non-undulating curved portion extending substantially from the support to a free end; and a reservoir configured to contain the product to be applied.

123. The system of claim 122, further comprising a product contained in the reservoir.

124. The system of claim 123, wherein the product is a cosmetic and/or care product configured for application to a keratinous surface.

125. The system of claim 124, wherein the product comprises a make-up product.

126. The system of claim 124, wherein the keratinous surface is on at least one of hair on an individual's head, fingernails, toenails, skin, eyelashes, and eyebrows.

127. The system of claim 124, wherein the product is mascara.

128. The system of claim 122, wherein the device further comprises a closure member configured to close the reservoir.

* * * * *

UNITED STATES PATENT AND TRADEMARK OFFICE

CERTIFICATE OF CORRECTION

PATENT NO. : 7,052,199 B2
APPLICATION NO. : 10/465624
DATED : May 30, 2006
INVENTOR(S) : Guilhem Rousselet It is certified that error appears in the above-identified patent and that said Letters Patent is hereby corrected as shown below:

Claim 105, col. 17, line 49, “a-second” should read --a second--.

Signed and Sealed this

First Day of August, 2006

JON W. DUDAS
*Director of the United States Patent and Trademark Office*